US006231091B1

(12) United States Patent
Gleason et al.

(10) Patent No.: US 6,231,091 B1
(45) **Date of Patent: *May 15, 2001**

(54) CONTROL MECHANISM FOR OPERATING A LATCH

(75) Inventors: Stephen James Gleason, Charles City; David Grant Iverson, New Hampton, both of IA (US)

(73) Assignee: Tri/Mark Corporation, New Hampton, IA (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/094,281

(22) Filed: Jun. 9, 1998

(51) Int. Cl.[7] ..... E05C 1/06
(52) U.S. Cl. ..... 292/34; 292/DIG. 37
(58) Field of Search ..... 292/34, 35, 36, 292/37, 41, 139, 140, 166, 168, 170, DIG. 37; 70/82, 120, 134, 360, 361, 467, 468, 478, 484, DIG. 20, 86

(56) References Cited

U.S. PATENT DOCUMENTS

| | | | | |
|---|---|---|---|---|
| 113,070 | * | 3/1871 | Loefflholz et al. | 292/34 |
| 480,148 | * | 8/1892 | Theby | 292/344 |
| 1,174,652 | * | 3/1916 | Banks | 292/344 |
| 1,368,141 | * | 2/1921 | Hagstrom | 292/34 |
| 1,907,625 | * | 5/1933 | Vogt | 292/140 |
| 1,908,980 | * | 5/1933 | Heyel | 292/344 |
| 2,322,040 | * | 6/1943 | Maruri | 292/166 |
| 2,460,607 | * | 2/1949 | Sullivan | 292/336.3 |
| 2,573,061 | * | 10/1951 | Raymond | 292/DIG. 37 |
| 2,683,978 | * | 7/1954 | Jacobi | 292/DIG. 37 |
| 3,058,766 | * | 10/1962 | Chanaryn | 292/336 |
| 3,545,799 | * | 12/1970 | Gertsfeld | 292/34 |
| 3,633,389 | * | 1/1972 | Horgan | 292/140 |
| 3,834,780 | * | 9/1974 | McClellan et al. | 70/82 |
| 4,445,729 | * | 5/1984 | Scheerhorn | 292/DIG. 49 |
| 4,601,499 | * | 7/1986 | Kim | 292/36 |
| 4,609,233 | * | 9/1986 | Walla | 70/86 |
| 4,741,563 | * | 5/1988 | Cohrs | 292/7 |
| 4,892,338 | * | 1/1990 | Weinerman et al. | 292/35 |
| 5,595,076 | * | 1/1997 | Weinerman et al. | 292/35 |
| 5,688,000 | * | 11/1997 | Dolman | 292/34 |
| 5,794,467 | * | 8/1998 | Justice | 292/344 |

FOREIGN PATENT DOCUMENTS

| | | |
|---|---|---|
| 582866 | 11/1946 | (GB) . |
| 821125 | 9/1959 | (GB) . |
| 898228 | 6/1962 | (GB) . |
| 930060 | 7/1963 | (GB) . |
| 1502545 | 3/1978 | (GB) . |

* cited by examiner

*Primary Examiner*—Steve Grady
(74) *Attorney, Agent, or Firm*—Wood, Phillips, VanSanten, Clark & Mortimer

(57) ABSTRACT

A control mechanism for operating a latch. The control mechanism has a frame and a first arm attached to the frame for pivoting movement relative to the frame around a first axis between first and second positions. The first arm has a first edge and a first connecting portion. The first connecting portion is connectable to a latch to effect operation of the latch connected to the first connecting portion as an incident of the first arm moving from the first position into the second position. An actuator assembly is translatable relative to the frame between normal and actuating positions along a line that is transverse to the first axis. The actuator assembly engages the first edge and causes the first arm to move from the first position into the second position as an incident of the actuator assembly moving from the normal position into the actuating position.

19 Claims, 7 Drawing Sheets

CONTROL MECHANISM FOR OPERATING A LATCH

BACKGROUND OF THE INVENTION

1. Field of the Invention

This invention relates to latches, as used for example on an enclosure element to releasably maintain the closure element in a closed state and, more particularly, to a control mechanism for changing the state of the latch. The invention is also directed to a system including the control mechanism and latch.

2. Background Art

Push-button types of actuators are used to operate latch systems on doors, lids, and other types of closures, in a number of different environments. It is known to simultaneously operate multiple rotary or slide bolt latches through a push-button actuator. It is also known to use a push-button actuator for operating a single rotary or slide bolt latch.

SUMMARY OF THE INVENTION

In one form of the invention, a control mechanism is provided for operating a latch. The control mechanism has a frame and a first arm attached to the frame for pivoting movement relative to the frame around a first axis between first and second positions. The first arm has a first edge and a first connecting portion. The first connecting portion is connectable to a latch to effect operation of the latch connected to the first connecting portion as an incident of the first arm moving from the first position into the second position. An actuator assembly is translatable relative to the frame between normal and actuating positions along a line that is transverse to the first axis. The actuator assembly engages the first edge and causes the first arm to move from the first position into the second position as an incident of the actuator assembly moving from the normal position into the actuating position.

In one form, a second arm is attached to the frame for pivoting movement relative to the frame around a second axis between third and fourth positions. The second arm has a second edge and a second connecting portion, with the second connecting portion being connectable to a latch to effect operation of a latch connected to the second connecting portion as an incident of the second arm moving from the third position into the fourth position.

In one form, the actuator assembly engages the second edge and causes the second arm to move from the third position into the fourth position as an incident of the actuator assembly moving from the normal position into the actuating position.

The actuator assembly may move as one piece between the normal and actuating positions.

The actuator assembly may be spring biased towards the normal position.

In one form, the first arm has an L shape.

In one form, the first and second axes reside within a single plane and the actuator assembly is translatable in a first line between the normal and actuating positions, and the first line is orthogonal to the single plane.

In one form, the frame has first and second transverse legs cooperatively defining an L shape, the actuator assembly is supported on the first leg, and the first and second arms are each pivotably connected to the second leg.

The first and second transverse legs may be formed as one piece.

In one form, the frame has an opening which is fully surrounded by the first leg. The actuator assembly includes a plate which causes the first arm to move from the first position into the second position and the second arm to move from the third position into the fourth position as an incident of the actuator assembly moving from the normal position into the actuating position. The plate may extend through the opening in the frame.

In one form, the actuator assembly plate abuts the first and second edges, and thereby causes the first arm to move from the first position into the second position and the second arm to move from the third position into the fourth position as an incident of the actuator moving from the normal position into the actuating position.

The first edge may have a curved configuration.

The plate may have a flat surface which abuts to the first edge.

The flat surface on the plate may reside in a plane that is substantially parallel to the single plane.

A cantilevered finger grip may be provided having a surface against which a user's finger on one hand can be placed to facilitate pressing by another finger on the user's one hand against the actuator assembly.

The control mechanism may be provided in combination with a latch having first and second operating states and a linkage acting between the first connecting portion of the first arm and the latch to change the latch from the first operating state into the second operating state as an incident of the first arm moving between the first and second positions.

The invention is also directed to a control mechanism for operating a latch, which control mechanism has a frame and a first arm attached to the frame for pivoting movement relative to the frame around a first axis between first and second positions. The first arm has a first connecting portion that is connectable to a latch to effect operation of a latch connected to the first connecting portion as an incident of the first arm moving from the first position into the second position. The actuato r assembly is translatable relative to the frame between normal and actuating positions along a line that is transverse to the first axis. The actuator assembly causes the first arm to move from the first position into the second position as an incident of the actuator assembly moving from the normal position into the actuating position.

A second arm may be attached to the frame for pivoting movement relative to the frame around a second axis between third and fourth positions. The second arm has a second connecting portion that is connectable to a latch to effect operation of a latch connected to the second connecting portion as an incident of the second arm moving from the third position into the fourth position. The second arm moves from the third position into the fourth position as an incident of the actuator assembly moving from the normal position into the actuating position.

The first and second axes may be substantially parallel to each other. In one form, the actuator assembly is movable along a first line between the normal and actuating positions and the first line is substantially perpendicular to the first and second axes.

The control mechanism may be provided in combination with a latch having first and second operating states and a linkage which acts between the connecting portion on the first arm and the latch to cause the latch to change from the first state into the second state as an incident of the first arm moving from the first position into the second position.

DETAILED DESCRIPTION OF THE DRAWINGS

Figure 1:
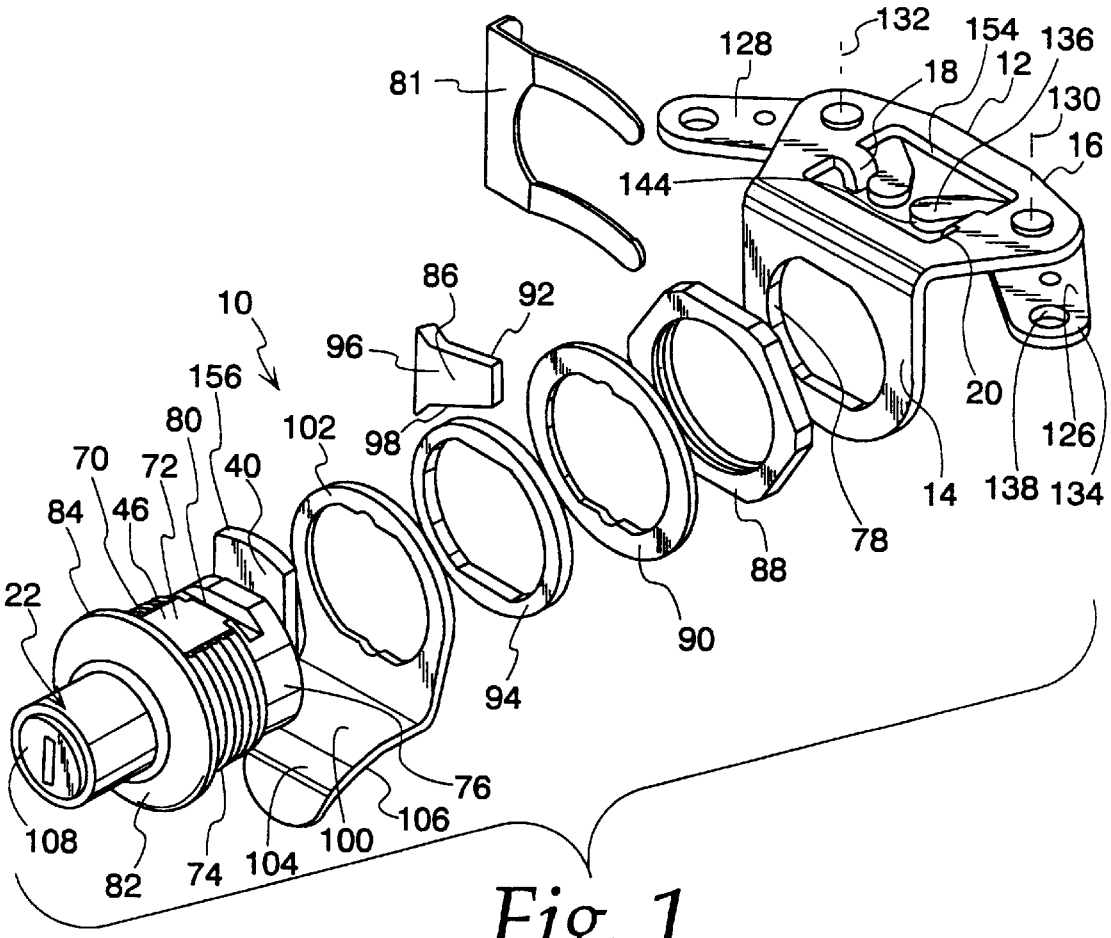
FIG. 1 is an exploded perspective view of a control mechanism, according to the present invention.
Figure 3:
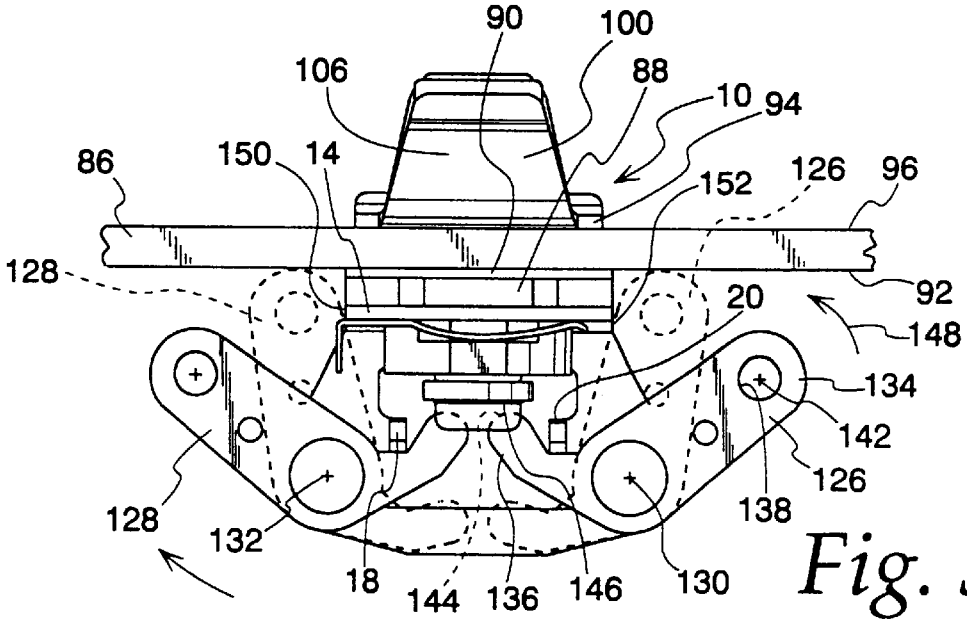
FIG. 3 is a bottom view of the inventive control mechanism.
Figure 2:
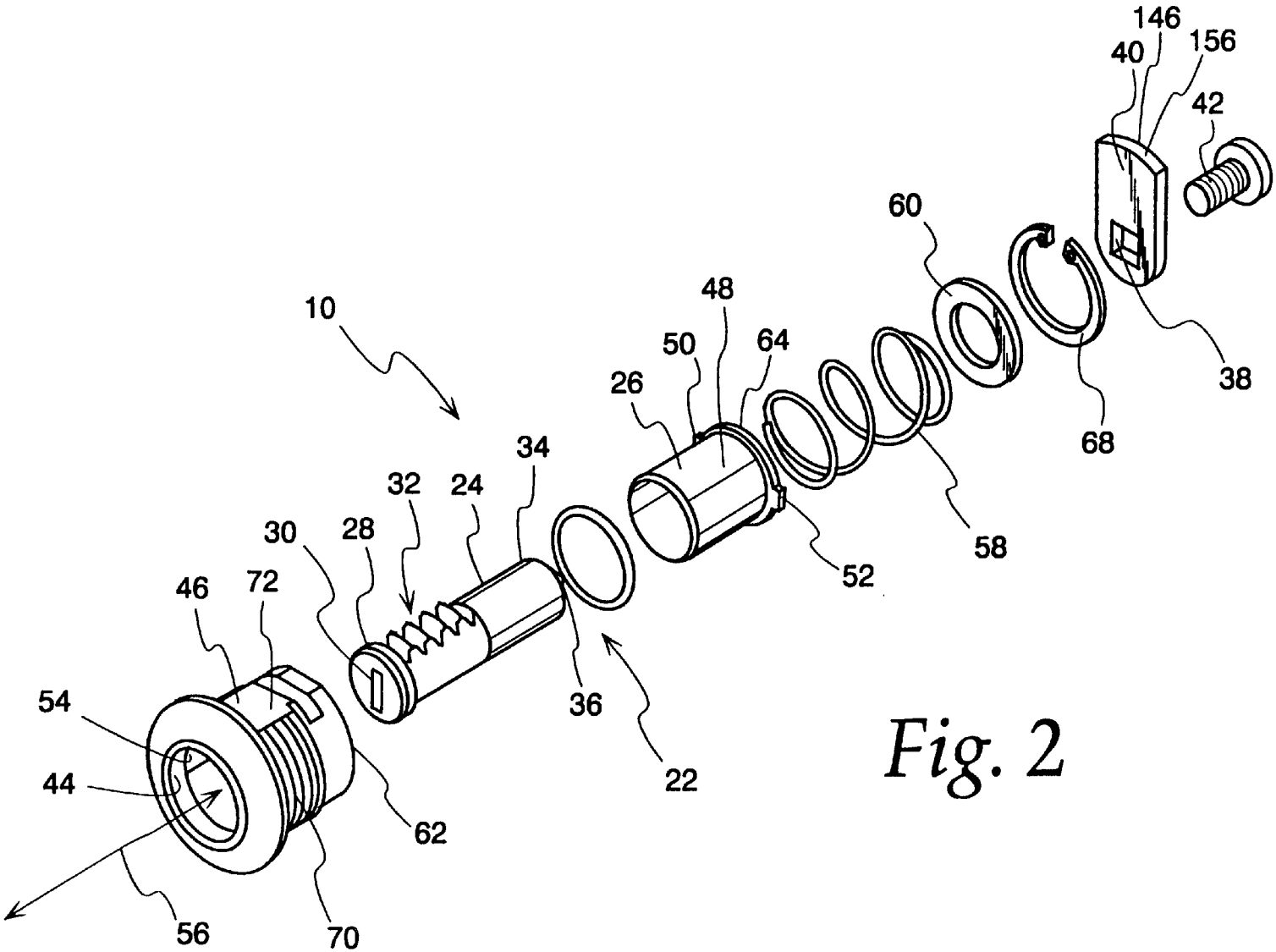
FIG. 2 is an exploded perspective view of a part of the inventive control mechanism.
Figure 4:
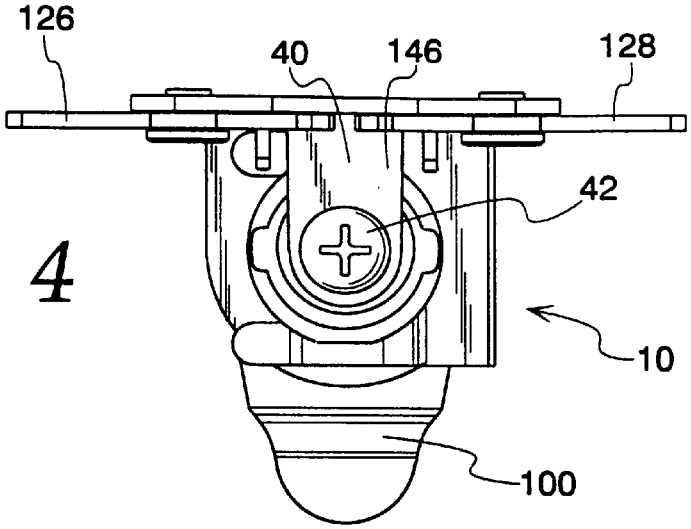
FIG. 4 is a rear elevation view of the inventive control mechanism.
Figure 5:
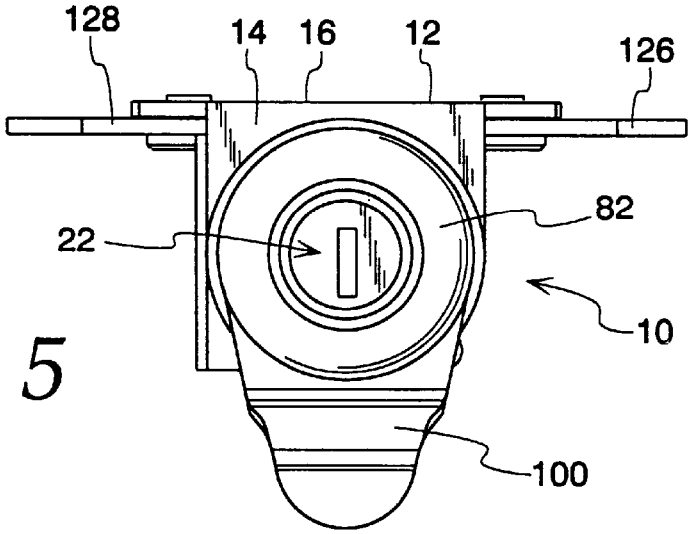
FIG. 5 is a front elevation view of the inventive control mechanism.
Figure 6:
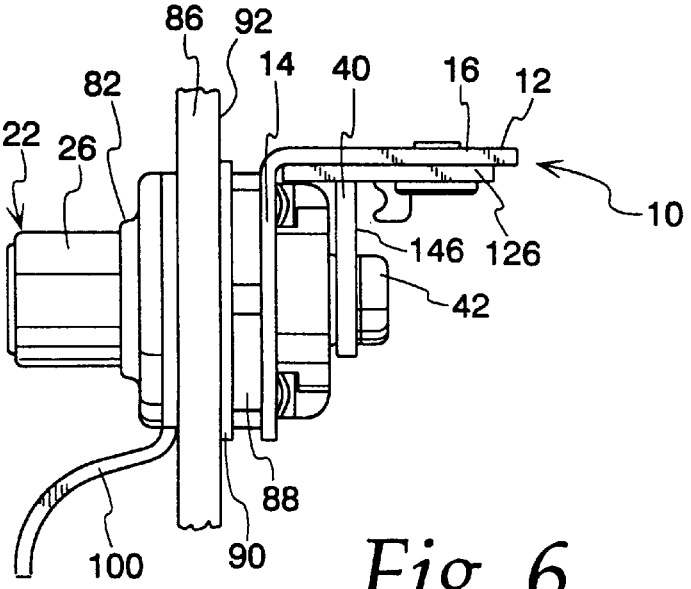
FIG. 6 is a side elevation view of the inventive control mechanism mounted to a wall on a closure element.

Referring initially to FIGS. 1–8, a control mechanism, according to the present invention, is shown at 10. The control mechanism 10 is operable to change the state of one or more latches associated with a closure element to which the control mechanism 10 is mounted, as hereinafter described, particularly with respect to FIGS. 7–12. The control mechanism 10 consists of a frame 12 having first and second orthogonal legs 14, 16 made from substantially flat material si tgat the legs 14, 16, cooperatively defining an L shape. In a preferred form, a single piece defines the first and second legs 14,16 and depending stops 18, 20, which function as hereinafter described.

The first leg 14 defines a support for an actuator assembly 22. The actuator assembly 22 consists of a keyed lock cylinder 24 which extends through a sleeve 26. The forward end 28 of the cylinder 24 has a keyway 30 to accept a key (not show) used to operate a conventional locking mechanism at 32. The rear end 34 of the cylinder 24 projects through and to rearwardly of the sleeve 26. The rear end 34 has a projection 36 which is keyed within a complementary opening 38 through a plate 40. A screw 42 captively holds the plate 40 to the cylinder end 34.

The actuator assembly 22, consisting of the lock cylinder 24, sleeve 26, and plate 40, is movable as one piece guidingly in translatory movement through a bore 44 in a housing 46. The diameter of the external surface 48 of the sleeve 26 is sized to be slightly less than the diameter of the bore 44 to slide smoothly therethrough without significant interference. Diametrically oppositely projecting tabs 50, 52 are movable, one each in keyways 54 (one shown), so that the actuator assembly 22 is consistently angularly oriented relative to the housing 46. The cooperating tabs 50, 52 and keyways 54 guide the lock cylinder 24 in translatory movement relative to the housing 46 along a line indicated by the double-headed arrow 56, which is parallel to the central axis of the housing 46.

The lock cylinder 24 is normally biased to a forward position by a coil spring 58. The spring 58 surrounds the lock cylinder 24 and is captively loaded between a washer 60 at the rear end 62 of the housing 46 and the rear surface 64 of the sleeve 26. The washer 60 is limited in rearward movement by a C-clip 68 which attaches conventionally at the rear end 62 of the housing 46.

The housing 46 has a threaded external surface 70 with diametrically oppositely located flats 72, 74. An unthreaded portion 76 of the housing 46, having the same flatted configuration, extends through a complementary bore 78 to make a keyed connection with the first leg 14 on the frame 12. Slots 80 (one shown) at diametrically opposite locations on the housing portion 76. accept a conventional spring clip 81, which maintains the housing 46 and frame 12 in operative relationship.

The housing 46 has an enlarged flange 82 defining a rearwardly facing, annular shoulder 84. The shoulder 84 can be drawn against a wall 86 on an enclosure to which the control mechanism 10 is mounted through a nut 88 that is threaded to the surface 70 of the housing 46. A metal washer 90, which is keyed to the housing portion 76, resides between the nut 88 and the rear surface 92 of the wall 86. A rubber gasket 94, also keyed to the housing portion 76, resides between the front surface 96 of the wall 86 and the shoulder 84. By tightening the nut 88, the wall 86 can be firmly captively held between the nut 88 and shoulder 84. The gasket 94 leakproofs the region between the housing surface 70 and an opening 98 in the wall through which the control mechanism 10 projects.

A grasping element 100 is provided and has a body 102 which is keyed to the housing portion 76 and a cantilevered finger grip 104 projecting from the body 102. The finger grip 104 has a curved, rearwardly facing surface 106 which can be grasped as by the user's index finger, as shown in FIGS. 7 and 8, to brace the hand to facilitate pressing of the forward surface 108 of the actuator assembly 22 with the thumb on the same hand to effect rearward translatory movement thereof relative to the housing 46.

Figure 7:
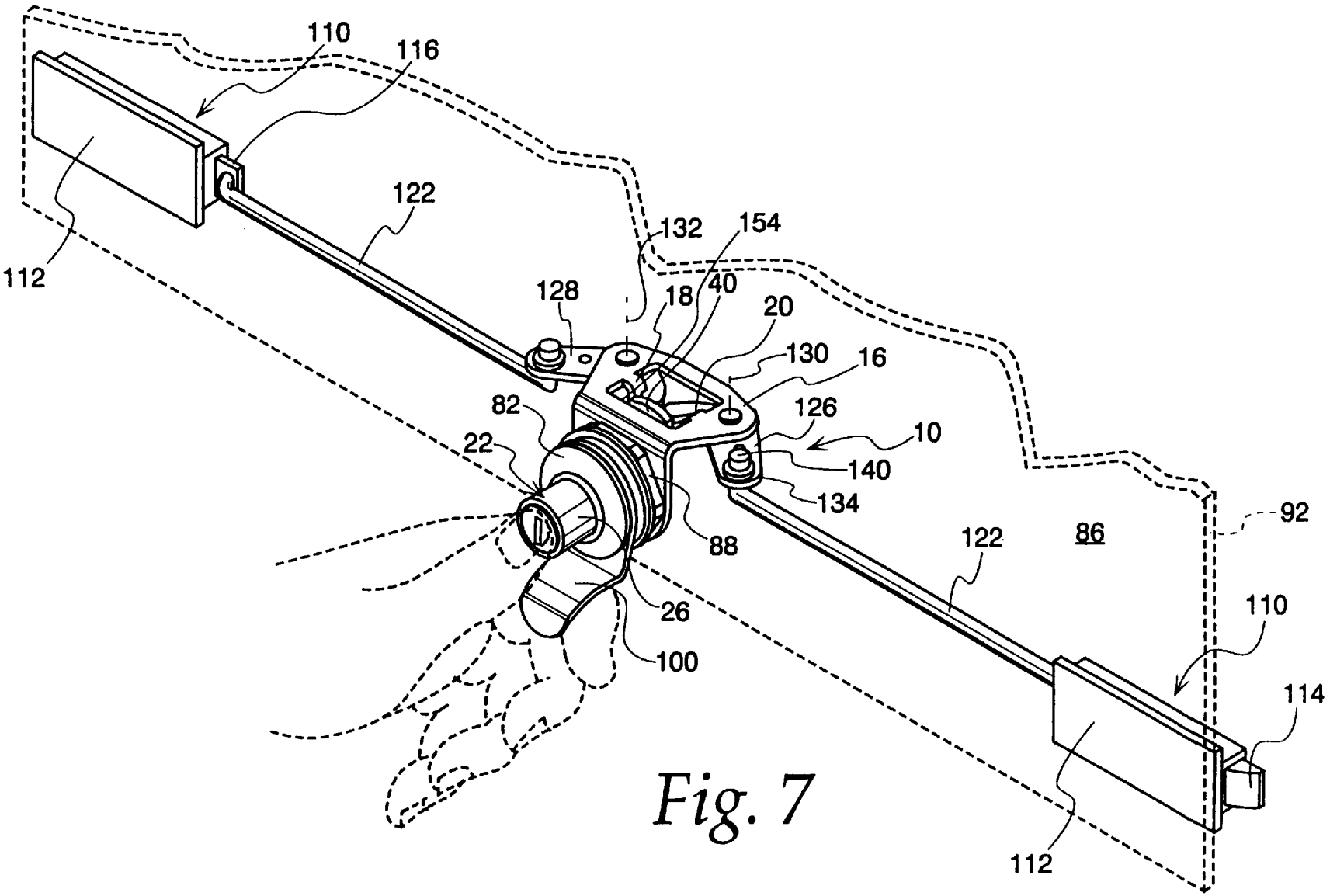
FIG. 7 is a reduced, perspective view of the inventive control mechanism operatively connected to a pair of latches and mounted on a closure element, with the latches in a first state.
Figure 8:
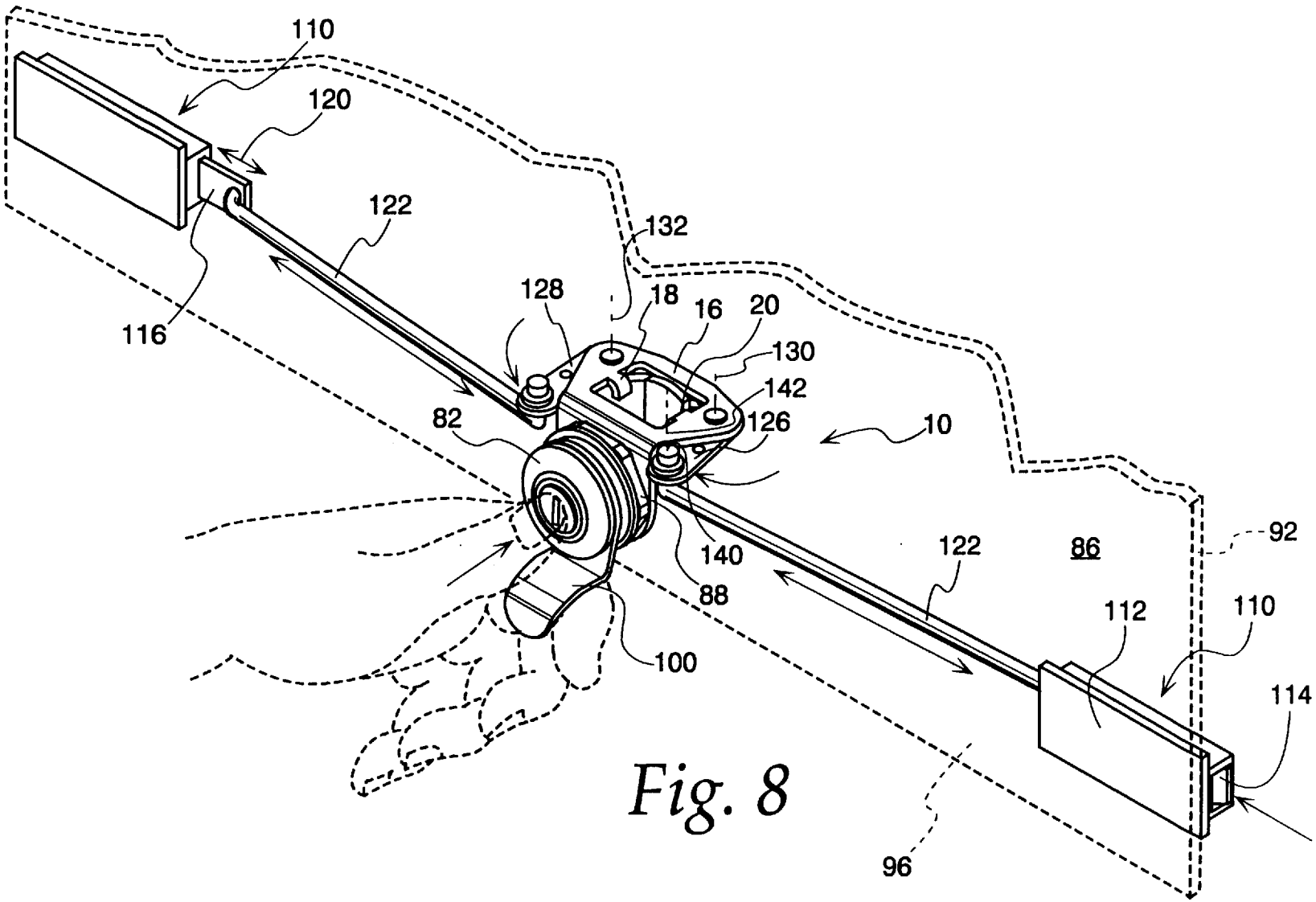
FIG. 8 is a view as in FIG. 7 with the control mechanism operated to change the latches from the first state into a second state.
Figure 9:
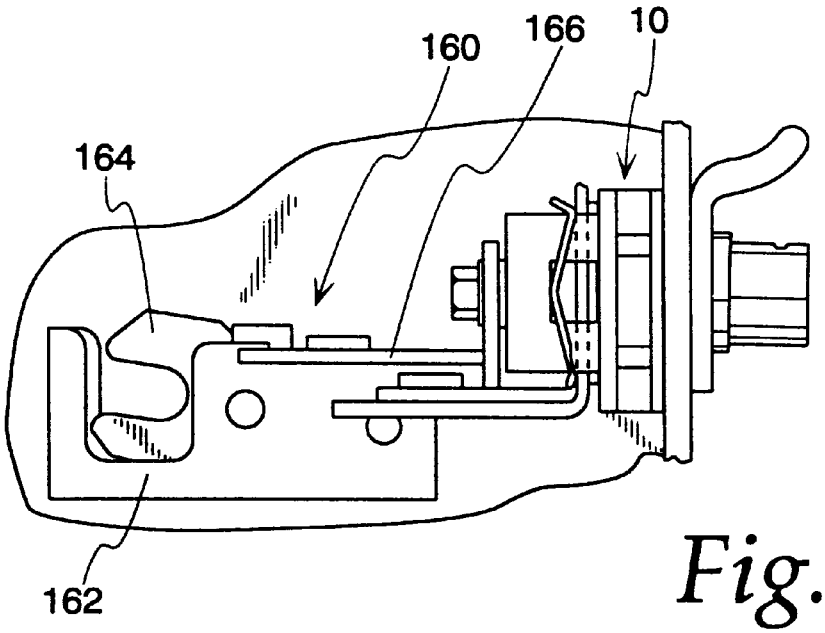
FIG. 9 is a side elevation view of the inventive control mechanism operatively mounted to a wall on a closure element and operatively connected to another type of latch and with the latch in a first state.
Figure 10:
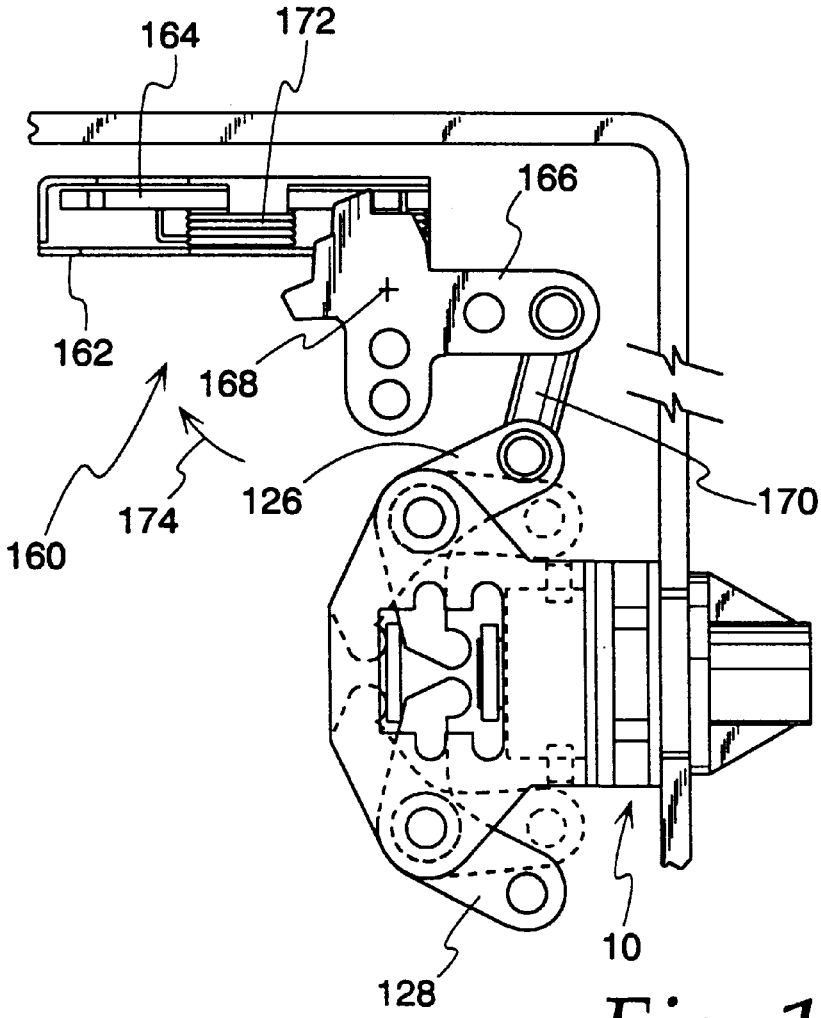
FIG. 10 is a bottom view of the control mechanism and latch in FIG. 9, with the latch in the first state.

The actuator assembly 22 is translatable between a normal position, shown in FIGS. 1 and 7, wherein the spring 58 biases the actuator assembly 22 fully forwardly, and an actuating position, shown in FIG. 8, wherein the actuator assembly 22 is shifted rearwardly.

Movement of the actuator assembly 22 causes operation of one or more remote latch assemblies 110. The latch assembly 110 is but exemplary of a number of different latch assemblies that can be operated using the inventive control mechanism 10. Each latch assembly 110 consists of a housing 112 which guides movement of a latch element 114 between an extended position, shown in FIG. 7, and a retracted position, shown in FIG. 8. FIG. 7 represents the latched state for the latch assembly 110, whereas FIG. 8 represents the unlatched state for the latch assembly 110. Each latch element 114 is movable through a slide plate 116 which is translatable in the line of the double-headed arrow 120.

Movement of the slide plates 116, and as a result the latch elements 114, is imparted through linkages 122, cooperating one each between the control mechanism and a latch assembly 110. The translatory movement of the actuator assembly 22 is converted to a transverse translatory movement of the linkages 122 through a mechanism, as described below.

More particularly, the second frame leg 16 supports first and second L-shaped arms 126, 128 for pivoting movement around axes 130, 132, which are substantially parallel to each other and orthogonal to the line of movement of the actuator assembly 22. In a preferred form, the axes 130, 132 reside in a plane which is orthogonal to the line of movement of the actuator assembly 22.

The arms 126, 128 have the same construction and are mounted as mirror images of each other upon the leg 16. Exemplary leg 126 has a linkage connecting portion 134 and a driven portion 136. The connecting portion 134 has an opening 138 to accept a bent end 140 on the linkage 122 so that the end 140 is pivotable about an axis 142 relative to the arm 126.

The driven portion 136 of the arm 126 has a curved edge 144 that is engaged by a flat surface 146 on the plate 40 as the actuator assembly 22 is moved rearwardly. As the flat surface 146 engages the edge 144 and advances rearwardly, the arm 126 is caused to pivot in the direction of the arrow 148 around the axis 130. The rounded contour of the edge 144 allows the edge 144 and surface 146 to slide against each other as the plate 40 and arm 126 reposition. Through this interaction, the arm 126 is pivotable between a first position, shown in FIGS. 3 and 7, and a second position, shown in phantom lines in FIG. 3 and in FIG. 8. Movement of the arm 126 from its first position into its second position causes the linkage 122 to cause the latch assembly 110 to change from the latched state to the unlatched state therefor, i.e., from the state in FIG. 7 to the state in FIG. 8.

The plate 40 cooperates with the second arm 128 in the same manner to cause the second arm to reposition the associated linkage 122 to change the state of the associated latch assembly 110.

The frame stops 18, 20 abut to the legs 128, 126 to limit pivoting of each arm 126, 128 from its first position to beyond its second position. The edges 150, 152 of the frame leg 14 abut to the arms 126, 128 to limit movement of each of the arms 126, 128 from their second position to beyond their first position.

The frame leg 16 has an opening 154 formed therethrough which is fully surrounded by the single piece defining the first and second frame legs 14, 16. The plate 40 projects upwardly into, and preferably through, the opening 154. This allows the plate surface 146 to contact the arm edges 150, 152 at a location thereon below the top edge 156 of the plate 40.

Figure 11:
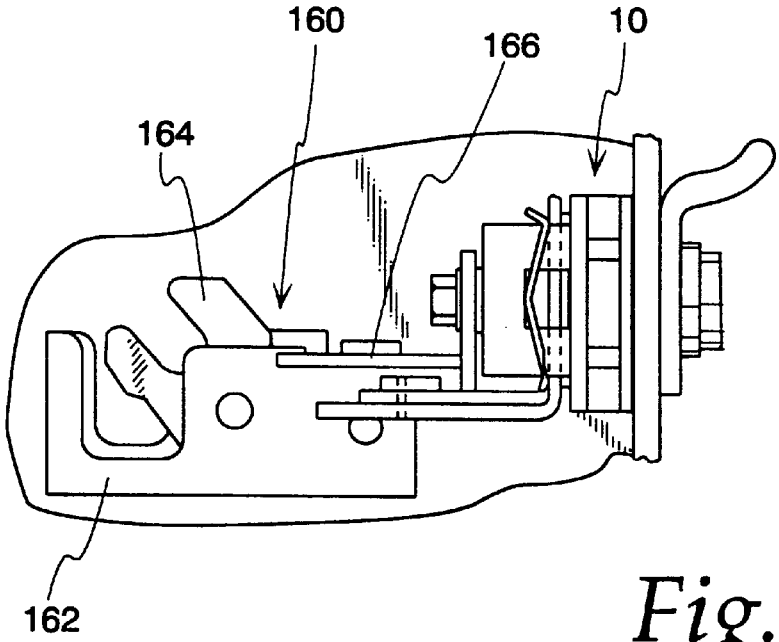
FIG. 11 is a view as in FIG. 9 with the control mechanism operated to change the latch into a second state.
Figure 12:
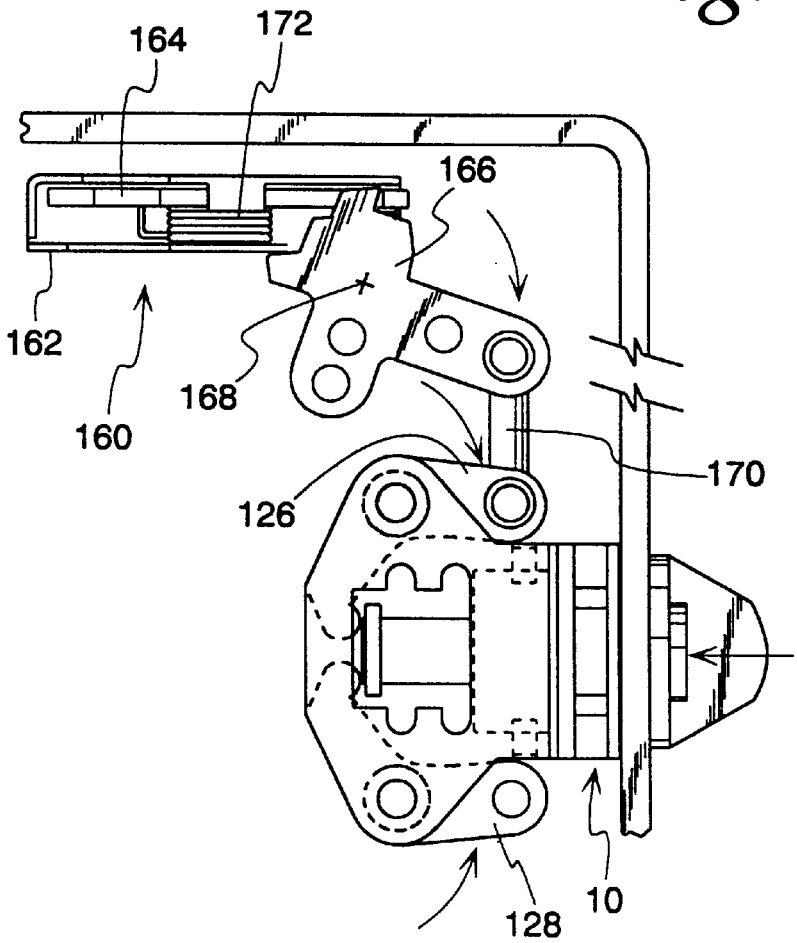
FIG. 12 s a bottom view of the control mechanism and latch, with the latch in the second state of FIG. 11.

In FIGS. 9–12, the control mechanism 10 is shown operatively connected to another type of latch assembly 160. The latch assembly 160 has a U-shaped housing 162 which supports a catch element 164 for pivoting movement between the position shown in FIGS. 9 and 10 and the position shown in FIGS. 11 and 12, representing two different states for the latch assembly 160. Changing of the latch assembly 160 between the states shown in FIGS. 9 and 10 and that of 11 and 12 is effected by pivoting an actuator arm 166 about an axis 168, which is accomplished by connecting the arm 126 to the arm 166 through a linkage 170 in the same manner as previously described for the linkage 122.

In this particular latch assembly construction, the catch element 164 is normally spring biased towards the position shown in FIGS. 11 and 12 by a coil spring 172. The actuating arm 166 overcomes this spring bias and in the position of FIGS. 9 and maintains the catch element 164 in the position of FIGS. 11 and 12. By pivoting the actuating arm 166 from the position in FIGS. 9 and 10 in the direction off the arrow 174, the catch element is allowed to pivot under the force of the spring 172 to the position of FIGS. 9 and 10.

The foregoing disclosure of specific embodiments is intended to be illustrative of the broad concepts comprehended by the invention.

We claim:

1. A control mechanism for operating a latch, said control mechanism comprising:

a frame having first and second legs made from substantially flat material so that the first and second legs cooperatively define an L shape;

a first arm attached to the first leg on the frame for pivoting movement relative to the frame around a first axis between first and second positions, said first arm having a first edge and a first connecting portion, the first connecting portion being connectable to the latch to effect operation of the latch as an incident of the first arm moving from the first position into the second position;

a housing that is attached to the second leg; and an actuator assembly in the housing, the actuator assembly translatable relative to the frame and housing between normal and actuating positions along a line that is transverse to the first axis, said actuator assembly engaging the first edge without extending through the first arm and causing the first arm to move from the first position into the second position as an incident of the actuator assembly moving from the normal position into the actuating position, said actuator assembly having a surface that is directly engagable and repositionable by an operator to thereby move the actuator assembly from the normal position into the actuating position.

2. The control mechanism according to claim 1 further comprising a second arm attached to the first leg on the frame for pivoting movement relative to the frame around a second axis between third and fourth positions, said second arm having a second edge and a second connecting portion, the second connecting portion being connectable to a second latch to effect operation of the second latch as an incident of the second arm moving from the third position into the fourth position.

3. The control mechanism according to claim 2 wherein the actuator assembly engages the second edge and causes the second arm to move from the third position into the fourth position as an incident of the actuator assembly moving from the normal position into the actuating position.

4. The control mechanism according to claim 3 wherein the actuator assembly moves as one piece between the normal and actuating positions.

5. The control mechanism according to claim 1 wherein the actuator assembly is spring biased towards the normal position.

6. The control mechanism according to claim 1 wherein the first arm has an L shape.

7. The control mechanism according to claim 2 wherein the first and second axes reside within a single plane, the actuator assembly is translatable in a first line between the normal and actuating positions, and the first line is orthogonal to the single plane.

8. The control mechanism according to claim 1 in combination with a latch having first and second different operating states and a linkage acting between the first connecting portion of the first arm and the latch to change the latch from the first operating state into the second operating state as an incident of the first arm moving between the first and second positions.

9. The control mechanism according to claim 1 wherein the first and second legs are formed as one piece.

10. The control mechanism according to claim 1 wherein the frame has an opening which is fully surrounded by the frame, the actuator assembly comprises a plate which translates along the line and causes the first arm to move from the first position into the second position and the second arm to move from the third position into the fourth position as an incident of the actuator assembly moving from the normal position into the actuating position, and the plate extends through the opening in the frame.

11. The control mechanism according to claim 2 wherein the actuator assembly includes a plate which abuts the first and second edges and thereby causes the first arm to move from the first position into the second position and the second arm to move from the third position into the fourth position as an incident of the actuator assembly moving from the normal position into the actuating position.

12. The control mechanism according to claim 11 wherein the first edge has a curved configuration.

13. The control mechanism for operating a latch according to claim 1 wherein the actuator assembly is not attached to the first leg on the frame.

14. A control mechanism for operating a latch, said control mechanism comprising:

a frame having first and second legs defining an L shape;

a first arm attached to the first leg on the frame for pivoting movement relative to the frame around a first axis between first and second positions, said first arm having a first edge and a first connecting portion, the first connecting portion being connectable to the latch to effect operation of the latch as an incident of the first arm moving from the first position into the second position; and an actuator assembly attached to the second leg on the frame, the actuator assembly translatable relative to the frame between normal and actuating positions along a line that is transverse to the first axis, said actuator assembly engaging the first edge without extending through the first arm and causing the first arm to move from the first position into the second position as an incident of the actuator assembly moving from the normal position into the actuating position, said actuator assembly having a surface that is directly engagable and repositionable by an operator to thereby move the actuator assembly from the normal position into the actuating position, the control further comprising a second arm attached to the first leg on the frame for pivoting movement relative to the frame around a second axis between third and fourth positions, said second arm having a second edge and a second connecting portion. the second connecting portion being connectable to a second latch to effect operation of the second latch as an incident of the second arm moving from the third position into the fourth position, wherein the first and second axes reside within a single plane, the actuator assembly is translatable in a first line between the normal and actuating positions, and the first line is orthogonal to the single plane, wherein the actuator assembly includes a plate which abuts the first and second edges and thereby causes the first arm to move from the first position into the second position and the second arm to move from the third position into the fourth position as an incident of the actuator assembly moving from the normal position into the actuating position, wherein the first edge has a curved configuration, wherein the plate has a flat surface which abuts to the first edge.

15. The control mechanism according to claim 14 wherein the flat surface on the plate resides in a plane that is substantially parallel to the single plane.

16. A control mechanism for operating a latch, said control mechanism comprising:

a frame having first and second legs defining an L shape;

a first arm attached to the first leg on the frame for pivoting movement relative to the frame around a first axis between first and second positions, said first arm having a first edge and a first connecting portion, the first connecting portion being connectable to the latch to effect operation of the latch as an incident of the first arm moving from the first position into the second position; and an actuator assembly attached to the second leg on the frame, the actuator assembly translatable relative to the frame between normal and actuating positions along a line that is transverse to the first axis, said actuator assembly engaging the first edge without extending through the first arm and causing the first arm to move from the first position into the second position as an incident of the actuator assembly moving from the normal position into the actuating position, said actuator assembly having a surface that is directly engagable and repositionable by an operator to thereby move the actuator assembly from the normal position into the actuating position, the control mechanism further comprising a cantilevered finger grip attached fixedly to the frame and having a surface against which a user's finger of one hand can be placed to facilitate pressing by another finger on the user's one hand against the actuator assembly.

17. A control mechanism for operating a latch, said control mechanism comprising:

a frame;

a first arm attached to the frame for pivoting movement relative to the frame around a first axis between first and second positions, said first arm having a first edge and a first connecting portion, the first connecting portion being connectable to the latch to effect operation of the latch as an incident of the first arm moving from the first position into the second position; and an actuator assembly that is translatable relative to the frame between normal and actuating positions along a line that is transverse to the first axis, said actuator assembly engaging the first edge and causing the first arm to move from the first position into the second position as an incident of the actuator assembly moving from the normal position into the actuating position, said actuator assembly having a surface that is directly engagable and repositionable by an operator to thereby move the actuator assembly from the normal position into the actuating position, the control further comprising a second arm attached to the frame for pivoting movement relative to the frame around a second axis between third and fourth positions, said second arm having a second edge and a second connecting portion, the second connecting portion being connectable to a second latch to effect operation of the second latch as an incident of the second arm moving from the third position into the fourth position, wherein the first and second axes reside within a single plane, the actuator assembly is translatable in a first line between the normal and actuating positions, and the first line is orthogonal to the single plane, wherein the actuator assembly includes a plate which abuts the first and second edges and thereby causes the first arm to move from the first position into the second position and the second arm to move from the third position into the fourth position as an incident of the actuator assembly moving from the normal position into the actuating position, wherein the first edge has a curved configuration, wherein the plate has a flat surface which abuts to the first edge.

18. A control mechanism for operating a latch, said control mechanism comprising:

a frame;

a first arm attached to the frame for pivoting movement relative to the frame around a first axis between first and second positions, said first arm having a first edge and a first connecting portion, the first connecting portion being connectable to the latch to effect operation of the latch as an incident of the first arm moving from the first position into the second position;

a housing; and an actuator assembly in the housing that is translatable relative to the frame between normal and actuating positions along a line that is transverse to the first axis, said actuator assembly engaging the first edge and causing the first arm to move from the first position into the second position as an incident of the actuator assembly moving from the normal position into the actuating position, said actuator assembly having a surface that is directly engagable and repositionable by an operator to thereby move the actuator assembly from the normal position into the actuating position, said control mechanism further comprising a cantilevered finger grip separate from the housing and attached fixedly to the frame by the housing and having a surface against which a user's finger on one hand can be placed to facilitate pressing by another finger on the user's one hand against the actuator assembly.

19. A control mechanism for operating a latch, said control mechanism comprising:

a frame having first and second legs defining an L shape;

a first arm attached to the first leg on the frame for pivoting movement relative to the frame around a first axis between first and second positions, the first leg having a stop for abutting to the first arm and limiting pivoting movement of the first arm in one direction around the first axis, there being a single piece that defines the first and second legs and the stop, said first arm having a first edge and a first connecting portion, the first connecting portion being connectable to the latch to effect operation of the latch as an incident of the first arm moving from the first position into the second position; and an actuator assembly attached to the second leg on the frame, the actuator assembly translatable relative to the frame between normal and actuating positions along a line that is transverse to the first axis, said actuator assembly engaging the first edge and causing the first arm to move from the first position into the second position as an incident of the actuator assembly moving from the normal position into the actuating position, said actuator assembly having a surface that is directly engagable and repositionable by an operator to thereby move the actuator assembly from the normal position into the actuating position.

* * * * *